US005196638A

United States Patent [19]

Hayashida et al.

[11] Patent Number: 5,196,638

[45] Date of Patent: Mar. 23, 1993

[54] MUTING DEVICE OF UPRIGHT PIANO

[75] Inventors: Hajime Hayashida; Satoshi Inoue; Toshiaki Sakai, all of Hamamatsu, Japan

[73] Assignee: Yamaha Corporation, Hamamatsu, Japan

[21] Appl. No.: 720,714

[22] Filed: Jun. 25, 1991

[30] Foreign Application Priority Data

Jun. 26, 1990 [JP] Japan ..... 2-167817
Apr. 10, 1991 [JP] Japan ..... 3-104804

[51] Int. Cl.[5] ..... G10C 3/18
[52] U.S. Cl. ..... 84/240; 84/236
[58] Field of Search ..... 84/236, 239, 240, 237, 84/238, 221

[56] References Cited

U.S. PATENT DOCUMENTS 4,061,067 12/1977 Carbone ..... 84/236
4,161,129 7/1979 Carbone ..... 84/240
4,860,626 8/1989 Tanaka et al. ..... 84/236
5,042,354 8/1991 Trivelas et al. ..... 84/240

FOREIGN PATENT DOCUMENTS 156817 9/1903 Fed. Rep. of Germany .
262349 9/1912 Fed. Rep. of Germany .

*Primary Examiner*—Stanley J. Witkowski
*Assistant Examiner*—Helen Kim
*Attorney, Agent, or Firm*—Spensley Horn Jubas & Lubitz

[57] ABSTRACT

A muting device of an upright piano which includes butt, a wippen, a capstan button and a muting mechanism (15). This butt rotates with a hammer which strikes a string of the upright piano. In addition, a jack is provided to come in contact with a lower surface of the butt, and rotates the butt in response to displacement of the key. The jack is supported by the wippen such that it can freely rotate. The capstan button is provided at a back edge portion of the key to transmit displacement of the key to the wippen. The muting mechanism is designed to reduce a string-striking stroke by rotating the hammer. Further, there is provided a key-displacement-transmission-rate changing mechanism. When reducing the string-striking stroke by the muting mechanism, this mechanism raises a displacement transmission point, at which displacement of the key is transmitted to the wippen, toward a rotation center of the key from the capstan button. Preferably, this mechanism includes another capstan button which is placed on an upper surface of the key at a position between the capstan button and rotation center of the key.

4 Claims, 9 Drawing Sheets

MUTING DEVICE OF UPRIGHT PIANO

BACKGROUND OF THE INVENTION

1. Field of the Invention

The present invention relates to a muting device built in an upright piano, which, reduces a tone volume of a piano sound.

2. Prior Art

In the conventional muting device of the upright piano, by stepping on a soft pedal, a hammer interlocking with the soft pedal is moved close to a string to thereby reduce a string-striking distance between them. This kind of muting device provides a transmitting mechanism which transmits a motion of a key to the hammer. However, among parts of the transmitting mechanism, there must be a gap between a jack and a butt, which deteriorates a key-touch feeling.

In order to eliminate such drawback, several types of muting devices, as disclosed in Japanese Utility-Model Laid-Open Publication No. 52-9429, Japanese Patent Laid-Open Publication No. 61-52696 and Japanese Utility-Model Laid-Open Publication No. 62-71690, are proposed, in which the wippen or the back side of key are raised in connection with the motion of the soft pedal.

However, even in the above-mentioned, improved muting device, there must be some problems as described below.

In the muting device employing the structure in which the wippen is raised, the key-striking operation is identical to that of the conventional muting device. Therefore, rotation range of the wippen must become too large, which reduces a hammer-stopping stroke. In addition, a distance between the jack and regulating button must be shortened, so that an escape timing of the jack must become too earlier, which deteriorates the key-touch feeling.

On the other hand, in the muting device employing the structure in which the back side of key is raised, the above-mentioned problems are not present. However, the key stroke must be reduced, by which the performer cannot obtain the satisfactory key-touch feeling.

SUMMARY OF THE INVENTION

It is accordingly a primary object of the present invention to provide a muting device of upright piano which can offer the satisfactory key-touch feeling without changing the hammer-stopping stroke and key stroke.

In an aspect of the present invention, there is provided a muting device of upright piano comprising:

a butt which rotates with a hammer striking a string of the upright piano;

a wippen which comes in contact with a lower surface of the butt, the wippen supporting a jack such that the jack can be freely rotated, wherein the jack rotates the bat in response to displacement of a key;

a capstan button, to be provided at a back edge portion of the key, for transmitting displacement of the key to the wippen;

a muting mechanism for rotating the hammer so that a string-striking stroke is reduced; and a key-displacement-transmission-rate changing mechanism for, when reducing the string-striking stroke by the muting mechanism, raising a displacement transmission point, at which displacement of the key is transmitted to the wippen, toward a rotation center of the key from the capstan button.

According to the present invention, the displacement transmission point is raised up from the key to the wippen. Therefore, even if the hammer is moved close to the string, there is no gap formed between some parts, e.g., jack and hammer bat in the string-striking mechanism.

In addition, the above-mentioned displacement transmission point is moved toward the rotation center of the key. Thus, in response to the reduced distance between the hammer and string, it is possible to reduce the rotation range of the wippen with respect to the key stroke.

BRIEF DESCRIPTION OF THE DRAWINGS

Further objects and advantages of the present invention will be apparent from the following description, reference being had to the accompanying drawings wherein preferred embodiments of the present invention are clearly shown.

In the drawings.

DESCRIPTION OF THE PREFERRED EMBODIMENTS

Figure 1:
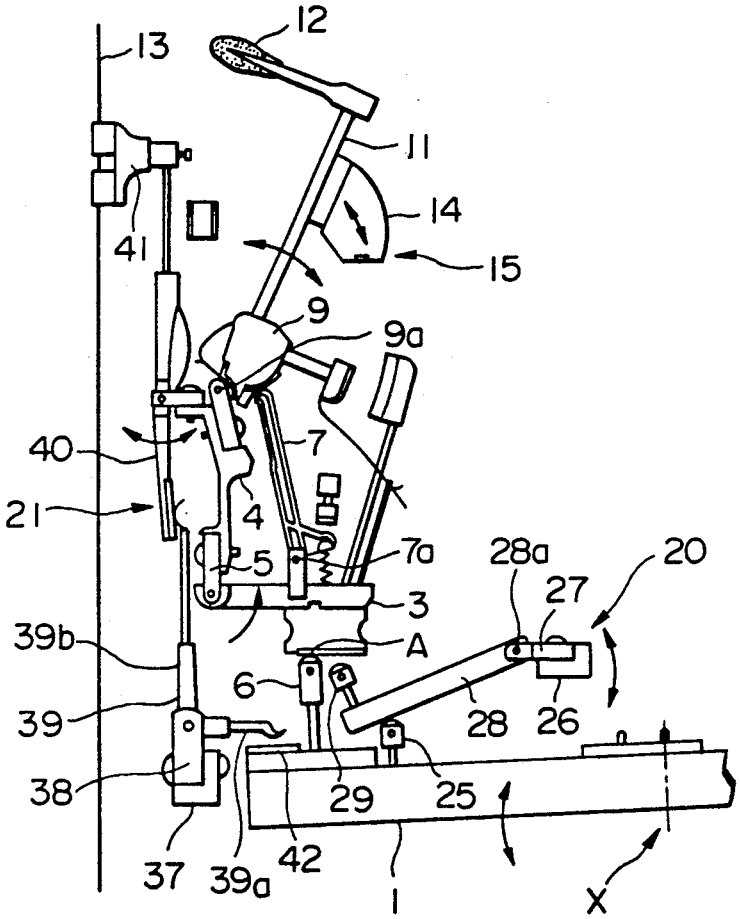
FIG. 1 is a sectional view illustrating an essential part of a muting device according to a first embodiment of the present invention in a state of normal performance.

Next, description will be given with respect to the preferred embodiments of the present invention by referring to the drawings, wherein parts identical to those shown in the drawings are designated by the same numerals and reference characters, hence, description thereof will be adequately omitted.

[A] First Embodiment

(1) Configuration

FIGS. 1 to 4 illustrates a muting device of upright piano according to a first embodiment of the present invention. Herein, 1 designates a key which is provided on a keyboard of piano and supported by a balance pin such that it can freely rotate about a rotation center X in vertical direction. In FIG. 1, right portion is called "front side", while left portion is called "back side". Above the backside portion of the key 1, a wippen 3 is supported by a pin of a wippen flange 5 such that it can freely rotate in vertical direction, wherein a back-edge portion of this wippen flange 5 is engaged with a center rail 4. In addition, a capstan button 6 is planted on the key 1, and it works to push up a lower portion of the wippen 3. When being pushed up, the wippen 3 is rotated in counterclockwise direction. Further, a jack 7 is mounted to the wippen 3 such that it can freely swing about a pin 7*a*.

Above the center rail 4, a hammer bat 9 is provided such that it can freely swing about a pin 9*a*. In addition, a hammer shank 11 is attached to the hammer butt 9, and a hammer head 12 is further mounted at a tip edge portion of this hammer shank 11. When the key 1 is depressed by the performer, the hammer butt 9 is pressed by the tip edge portion of the jack 7 and it is revolved so that the hammer head 12 strikes a string 13 shown in upper left side of FIG. 1.

Incidentally, the present embodiment provides a muting mechanism 15 which works as follows. When the performer steps on the soft pedal (not shown), step-on pressure thereof is transmitted to the hammer rail 14 via the transmitting mechanism so that the hammer rail 14 is rotated in counterclockwise direction. Thus, the hammer head 12 is moved close to the string 13, so that the string-striking stroke between the hammer head 12 and string 13 is reduced. This kind of muting mechanism 15 is well known, therefore, detailed description thereof will be omitted.

The above-mentioned string-striking mechanism of the present embodiment is fundamentally identical to that of the conventional upright piano except for a transmissin rate converting mechanism a key-displacement-transmission-rate changing mechanism 20. Due to the operation of this mechanism 20, when reducing the string-striking stroke by the muting mechanism 15, a displacement transmission point A at which displacement of the key 1 is transmitted to the wippen 3 is raised, and it is also moved apart from the capstan button 6 but toward the rotation center X of the key 1.

In addition, the present embodiment provides a damper mechanism 21 which is directly operated by the back-side portion of the key 1, regardless of the operation of the wippen 3.

Figure 2:
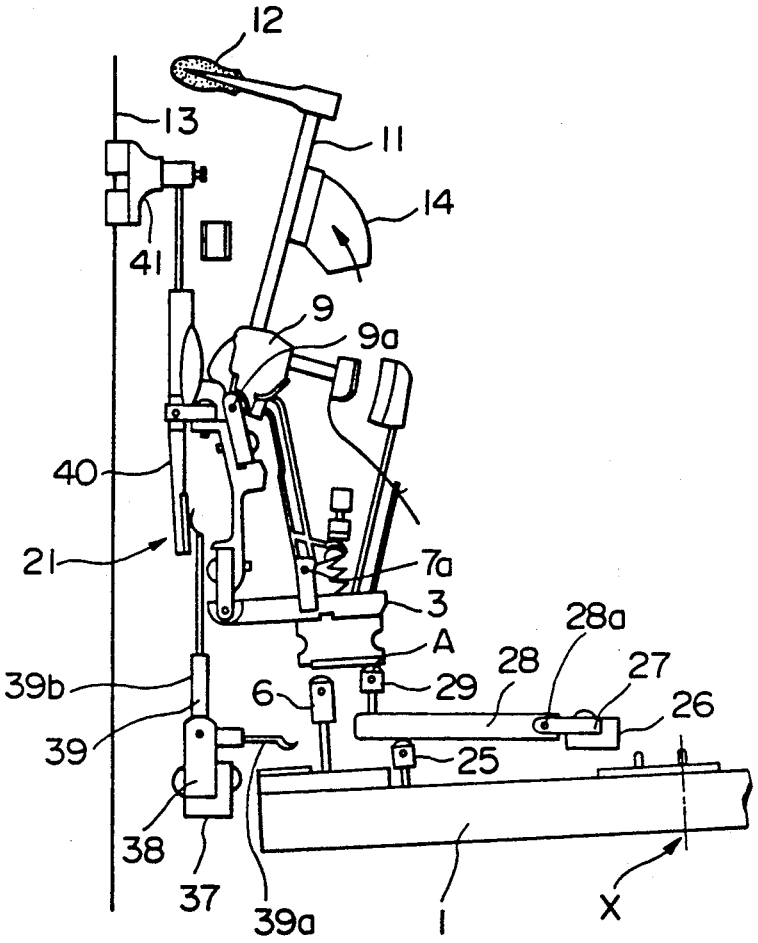
FIG. 2 is a sectional view illustrating an essential part of the muting device in a state of muting performance.

Next, detailed description will be given with respect to the transmission rate converting mechanism 20. Above the key 1, a second capstan button 25 is provided at a position between the first capstan button 6 and rotation center X. In addition, a bypass lever rail 26 is provided such that it can freely rotate in vertical direction. This bypass lever rail 26 is provided at a position above the key 1 in a front side of the wipen 3, and it has a longitudinal shape extending between a first key (i.e., lowest-pitch key) and an eighty-eighth key (i.e., highest-pitch key) of the piano. In addition, a flange 27 is coupled to the bypass lever rail 26, and at the tip edge portion thereof, a bypass lever 28 is attached such that it can freely swing about a pin 28*a* in vertical direction. The bypass lever rail 26 is interlocked with the soft pedal. When the performer steps on the soft pedal, the bypass lever rail 26 is rotated in clockwise direction and then lowered down as shown in FIG. 2. When releasing the step-on operation of the soft pedal, the bypass lever rail 26 is rotated in counterclockwise direction and then raised to its original place as shown in FIG. 1. The bypass lever 28 has a longitudinal shape which extends toward the foregoing first capstan button 6. As described before, this first capstan button 6 is normally provided in the upright piano. The head of the second capstan button 25 comes in contact with a lower surface of this bypass lever 28. In addition, a drive button 29 is planted at an upper surface of a tip edge portion of the bypass lever 28. In the muting performance, this drive button 29 pushes up the wippen 3 so that the wippen 3 is rotated.

In case of the normal performance as illustrated in FIG. 1, in other words, in the case where the soft pedal is not stepped on so that the bypass lever rail 26 is placed in relatively upper position, only the first capstan button 6 is in contact with the wipen 3 but the drive button 29 does not come in contact with the wippen 3 so that a gap is formed therebetween. On the other hand, in case of the muting performance, i.e., in the case where the soft pedal is stepped on so that the bypass lever rail 26 is lowered, only the drive button 29 comes in contact with the wippen 3 but the first capstan button 6 does not come in contact with the wippen 3 so that a gap is formed therebetween.

In case of the muting performance (wherein, for example, the string-striking stroke is reduced half as comparing to that of the normal performance), positions of the second capstan button 25 and drive button 29 are set respectively with respect to the pin 28*a* in order that a gap is not formed between the jack 7 and bat 9.

Figure 4:
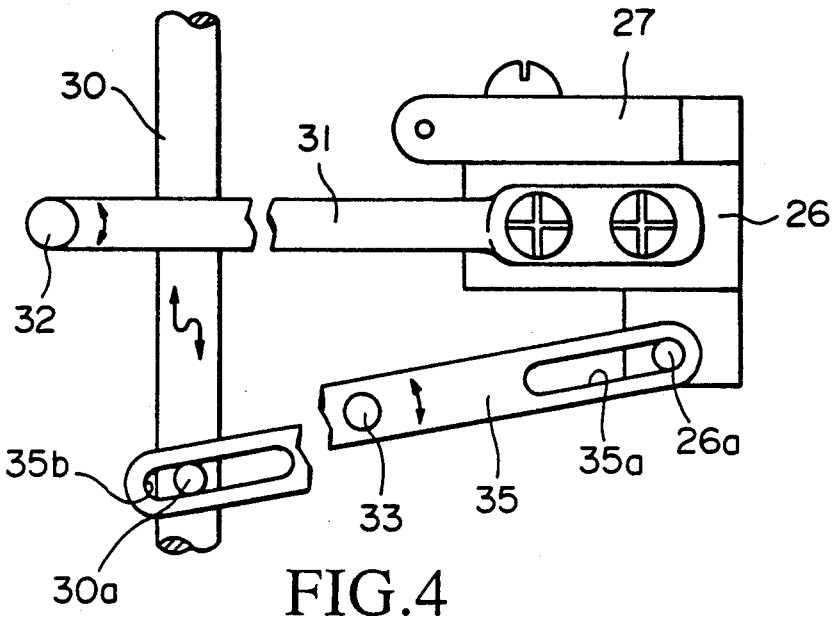
FIG. 4 is a side view illustrating an example of a connecting structure of a bypass lever rail and a soft pedal.

FIG. 4 illustrates an example of the interconnecting manner of the bypass lever rail 26 and soft pedal. Herein, 30 designates a connection rod interconnected with the soft pedal. This connection rod 30 is designed to move upward or downward in response to the step-on operation of the soft pedal. In addition, a horizontal arm 31 is connected to the bypass lever rail 26, and a tip edge portion of this arm 31 is supported by a pin 32 so that the bypass lever rail 26 can freely swing about the pin 32. Meanwhile, pins 26*a* and 30*a* are respectively planted to the bypass lever rail 26 and connection rod 30. These pins 26*a*, 30*a* are respectively engaged with long holes 35*a*, 35*b* of a connection arm 35 of which center is supported by a pin 33 so that it can freely swing about the pin 33. Thus, in accordance with the upward/downward movements of the connection rod 30, the bypass lever rail 26 can swing about the pin 32.

As illustrated in FIG. 1, in the damper mechanism 21, a L-shape arm 39 is supported by a flange 38 fixed to a damper rail 37 such that it can freely swing about its pin. When the back portion of the key 1, to be raised up, pushes up a horizontal spoon 39*a* of the L-shape arm 39, the L-shape arm 39 is rotated in counterclockwise direction. At this time, a tip edge portion of a vertical arm 39*b* pushes the lower edge portion of the damper lever 40, resulting that a damper head 41 is departed from the string 13.

In order to soften the impact or noise to be occured when the horizontal spoon 39*a* comes in contact with the back portion of the key 1, a flexible material 42 made of felt, cloth and the like is adhered to the upper surface of the back portion of the key 1.

(2) Operation

Next, description will be given with respect to the operation of the muting device of upright piano which is constructed according to the first embodiment as described above.

(a) Normal Performance

When the soft pedal (not shown) is not stepped on, parts of the muting device are set as illustrated in FIG. 1. More specifically, the bypass lever rail 26 is placed in upper position, while the first capstan button 6 is only in contact with the wippen 3. Then, when the key 1 is depressed, both of the first and second capstan buttons 6, 25 are rotated in clockwise direction.

The bypass lever 28, accompanied with rotation of the second capstan button 25, is rotated about the pin 28*a* in clockwise direction. At the same time, the drive button 29 is also rotated in clockwise direction. In the normal performance, however, the drive button 29 is not in contact with the lower surface of the wippen 3. Herein, there is established a certain lever ratio by which connection point between the first capstan button 6 and wippen 3 is placed outside of connection point between the second capstan button 25 and bypass lever 28 in radius direction of the rotation center X of the key 1. Due to this lever ratio, even if the key 1 is depressed to the lowest position, the drive button 29 does not come in contact with the lower surface of the wipen 3.

Therefore, in the normal performance, an input of the key 1 is transmitted in the normal path between the first capstan button 6 and wipen 3 as similar to the normal piano action.

(b) Muting Performance

When stepping on the soft pedal, the hammer rail 14 is rotated in counterclockwise direction so that the hammer shank 11 is also rotated in counterclockwise direction, resulting that the string-striking stroke is reduced. At this time, the bypass lever rail 26, interconnected with the soft pedal, is rotated about the pin 32 in clockwise direction so that it reaches the lower position thereof. Associated with this operation, while being in contact with the head portion of the second capstan button 25, the bypass lever 28 is approximately rotated about the second capstan button 25 in clockwise direction. At this time, the drive button is rotated up and raised with the back edge portion of the bypass lever 28. After the drive button 29 comes in contact with the wippen 3, the wippen 3 is rotated in counterclockwise direction. Therefore, the jack 7 is raised until a gap between the jack 7 and tail portion of the hammer bat 9 is eliminated.

FIG. 2 illustrates a state where the step-on operation of the soft pedal is completed. When a key-depression is made in this state, an input of the key 1 is transmitted in an order of the second capstan button 25, bypass lever 28, drive button 29 and wipen 3.

Then, the string-striking stroke is reduced half as comparing to that of the normal performance. At this time, no gap is formed between the jack 7 and hammer butt 9. In addition, the displacement transmission point A between the key 1 and wippen 3 is moved toward the rotation center X of the key 1, which reduces a rotation range of the wippen 3 half as comparing to that of the key 1. Thus, the string-striking stroke is shortened, however, it is possible to smoothly perform a music with the normal key stroke. In other words, displacement transmission rate between the key 1 and wipen 3 becomes half.

Figure 3:
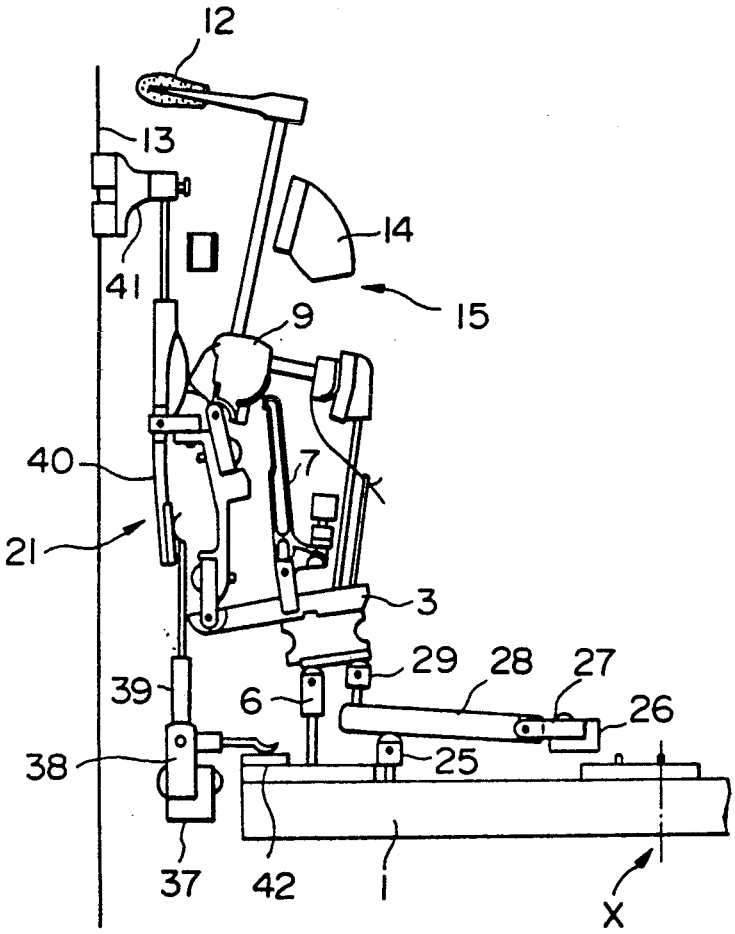
FIG. 3 is a sectional view of an essential part of the muting device in a hammer-stop state of the muting performance.

When the key-depression is made to the key 1, the damper mechanism 21 is also activated. However, the damper mechanism 21 is not affected by the wippen 3 and it is directly driven by the movement of the back portion of the key 1. Therefore, even if the rotation range of the wippen 3 becomes approximately half, motion of the wippen 3 does not affect the damper mechanism 21. FIG. 3 illustrates a hammerstop state wherein the performance is made with stepping on the soft pedal.

[B] Sècond Embodiment (1) Configuration

FIGS. 5 to 8 illustrates a muting device according to a second embodiment of the present invention. Incidentally, parts identical to those of the first embodiment will be designated by the same numerals. Different from the foregoing first embodiment, this second embodiment is characterized by employing a transmission-rate changing mechanism 20.

As similar to the first embodiment, the flange 27 is attached to the bypass lever rail 26 which is provided such that it can freely swing in vertical direction. At the tip edge portion of this flange 27, the bypass lever 28 is provided such that it can freely swing about the pin 28*a*.

In the second embodiment, a capstan button 51 is further planted on the upper surface of the key 1. On the other hand, first and second drive buttons 52, 53 are respectively planted on the upper surface of the back edge portion of the bypass lever 28. They are disposed by the predetermined interval, and they have the roughly same height.

Figure 6:
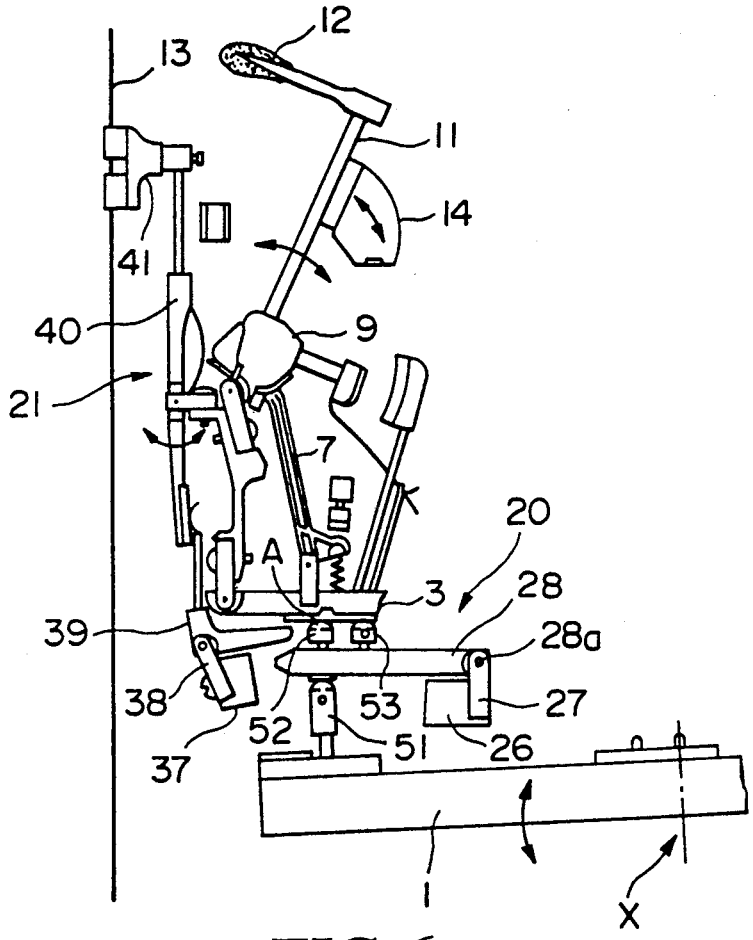
FIG. 6 is a sectional view illustrating an essential part of the muting device according to the second embodiment in a state of normal performance.
Figure 7:
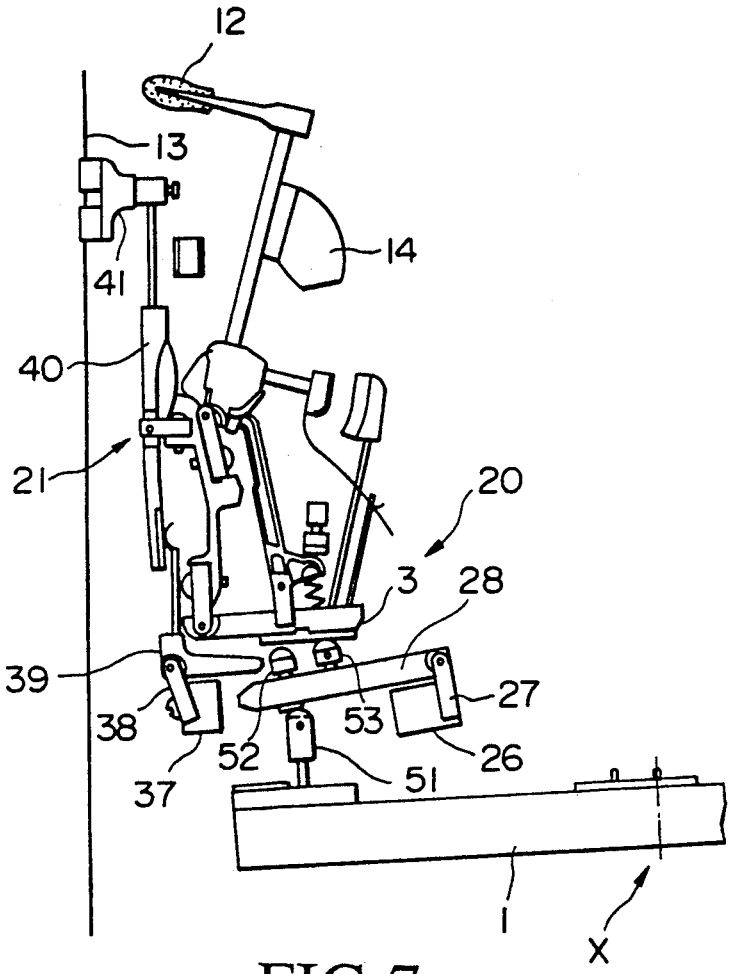
FIG. 7 is a sectional view illustrating an essential part of the muting device in a state of the muting performance.

In contrast to the first embodiment, the bypass lever rail 26 is placed at the predetermined lower position as illustrated in FIG. 6 in a state of the normal performance where the soft pedal is not depressed. On the other hand, when the soft pedal is stepped on, this bypass lever rail 26 is raised to the upper position as illustrated in FIG. 7. The capstan button 51 is placed to come in contact with the lower surface of the tip edge portion of the bypass lever 28 at a position just below the first drive button 52.

Further, in the damper mechanism 21, the L-shape arm 39 is supported by the flange 38 fixed to the damper rail 37 such that it can freely swing about the pin. When the horizontal portion of the L-shape arm 39 is pushed by the raising tip edge portion of the bypass lever 28, the L-shape arm 39 is rotated in counterclockwise direction. At this time, the damper spoon pushes the damper lever 40, so that the damper head 41 is departed from the string 13. In order to obtain the constant power-transmission-timing in both of the normal performance and muting performance, the tip edge portion of the bypass lever 28 has an inclined shape.

Figure 5:
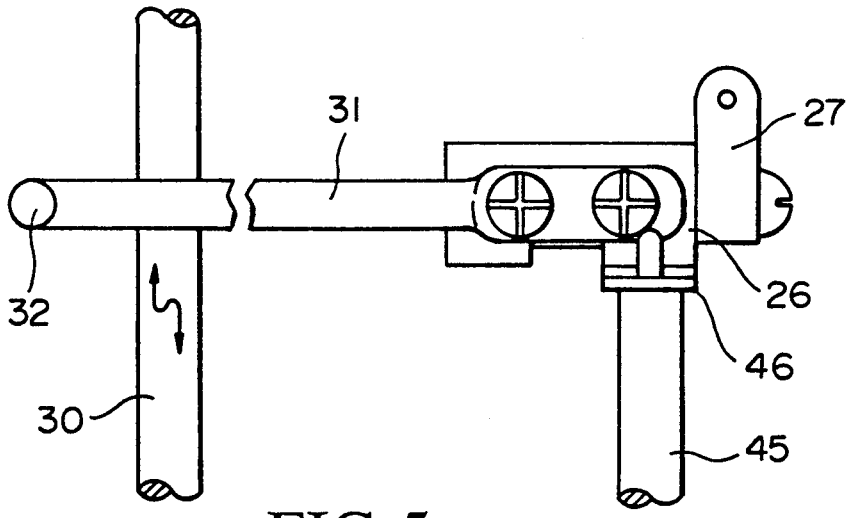
FIG. 5 is a side view illustrating a connecting structure of the bypass lever rail and soft pedal in a muting device according to a second embodiment of the present invention.

FIG. 5 illustrates an interconnecting manner between the soft pedal and bypass lever rail 26 in the second embodiment. Herein, a connection rod 45 is moved upward/downward in response to the step-on amount of the soft pedal, and it is provided in front of the foregoing connection rod 30. This connection rod 45 is connected to the bypass lever rail 26 by means of a joint member 46 such that it can slightly rotate.

(2) Operation

Next, description will be given with respect to the operation of the muting device according to the second embodiment.

(a) Normal Performance

In the normal performance wherein the soft pedal is not stepped on as illustrated in FIG. 6, both of the first and second drive buttons 52, 53 are in contact with the wippen 3. In this state, an input of the key to be depressed is transmitted in an order of the capstan button 51, bypass lever 28, first drive button 52 and wippen 3, so that the hammer head 12 will strike the string 13.

(b) Muting Performance

When the performer steps on the soft pedal, due to the operation of the mechanism as shown in FIG. 5, the bypass lever rail 26 is raised and rotated in counterclockwise direction as illustrated in FIG. 7, so that the bypass lever 28 is rotated about the summit portion of the capstan button 51 approximately in counterclockwise direction. Accompanied with this motion, the second drive button 53 is raised so that the wippen 3 is rotated in counterclockwise direction. This motion prevents a gap from being formed between the jack 7 and hammer bat 9. At the same time, contact portion between the drive button and wippen 3 is moved toward the rotation center X of the key 1.

Figure 8:
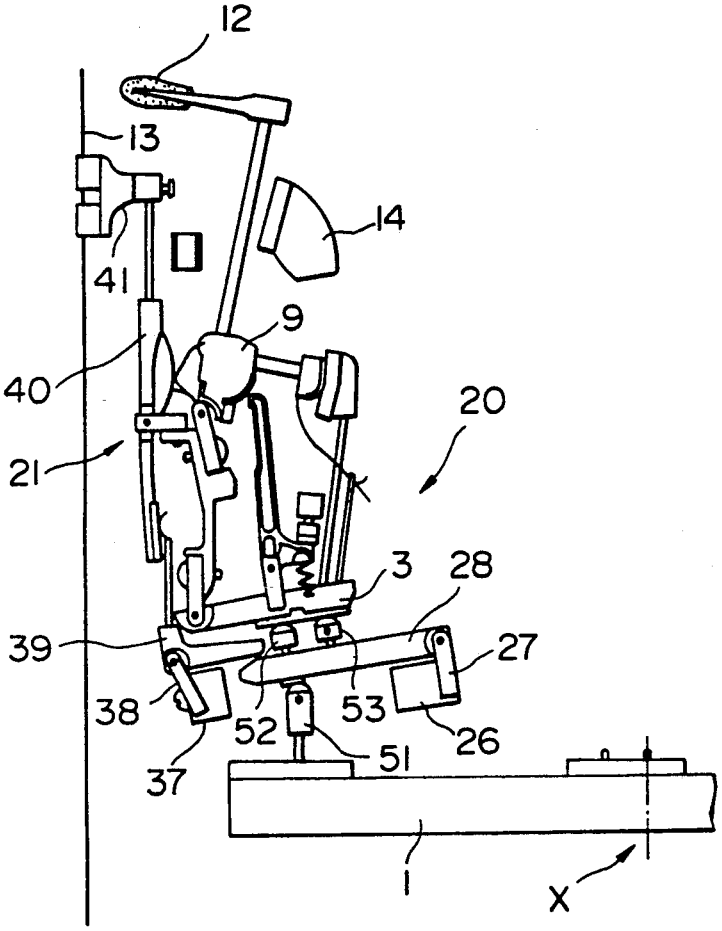
FIG. 8 is a sectional view illustrating an essential part of the muting device in a hammer-stop state of the muting performance.

Thereafter, a key-input-transmission-path in the keydepression is formed in an order of the capstan button 51, bypass lever 28, second drive button 53 and wippen 3. In this case, the first drive button 52 will not come in contact with the wippen 3. However, accompanied with rotation of the key 1, the above-mentioned second drive button 53 will be lastly replaced by the first drive button 52. FIG. 8 illustrates a hammer-stop state of the muting performance wherein the soft pedal is depressed.

(3) Modified Example

It is possible to modify the second embodiment such that the second drive button 53 has a slightly lowered height as comparing to the first drive button 52.

According to the above-mentioned modification, in the normal performance, only the first drive button 52 is in contact with the lower surface of the wippen 3. Thus, an input of the key to be depressed is transmitted in an order of the capstan button 51, bypass lever 28, first drive button 52 and wippen 3, so that the hammer head 12 will strike the string 13. In the muting performance, operation of this modification is identical to that of the second embodiment.

This modification of the second embodiment is designed such that, in the normal performance, only the first drive button 52 is in contact with the wippen 3 at first. Therefore, it is required to adjust the capstan button 51 only, which improves the operation.

Thus, by adequately selecting heights of the first and second drive buttons 52, 53, it is possible to set the satisfactory key-touch feeling.

[C] Third Embodiment (1) Configuration

Figure 9:
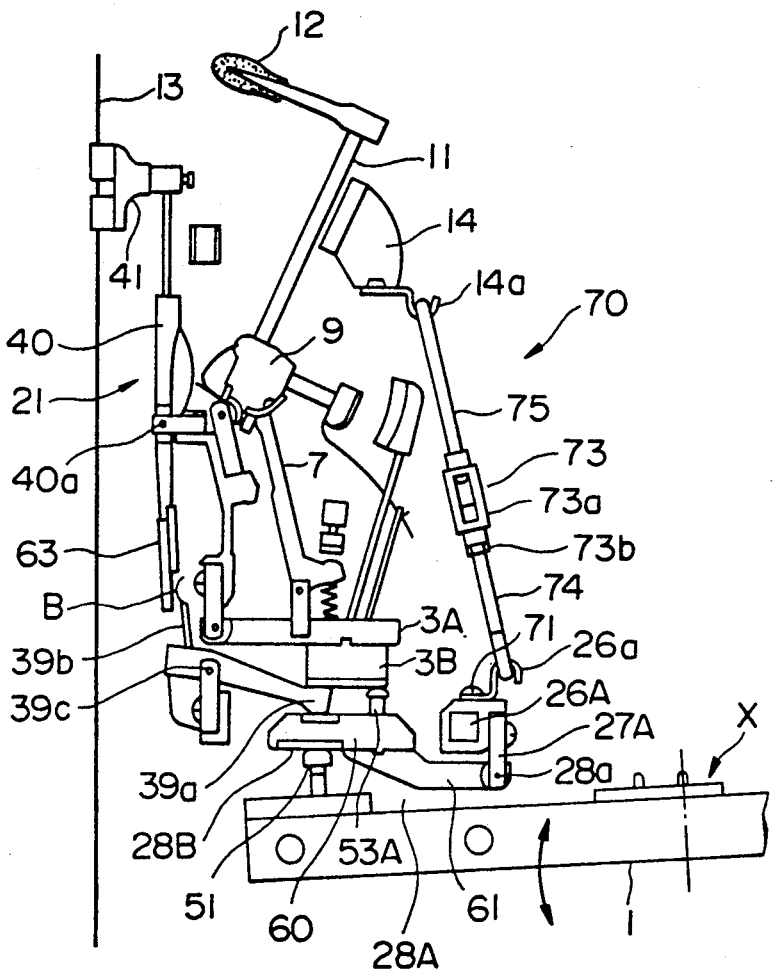
FIG. 9 is a sectional view illustrating an essential part of a muting device according to a third embodiment in a state of normal performance.
Figure 10:
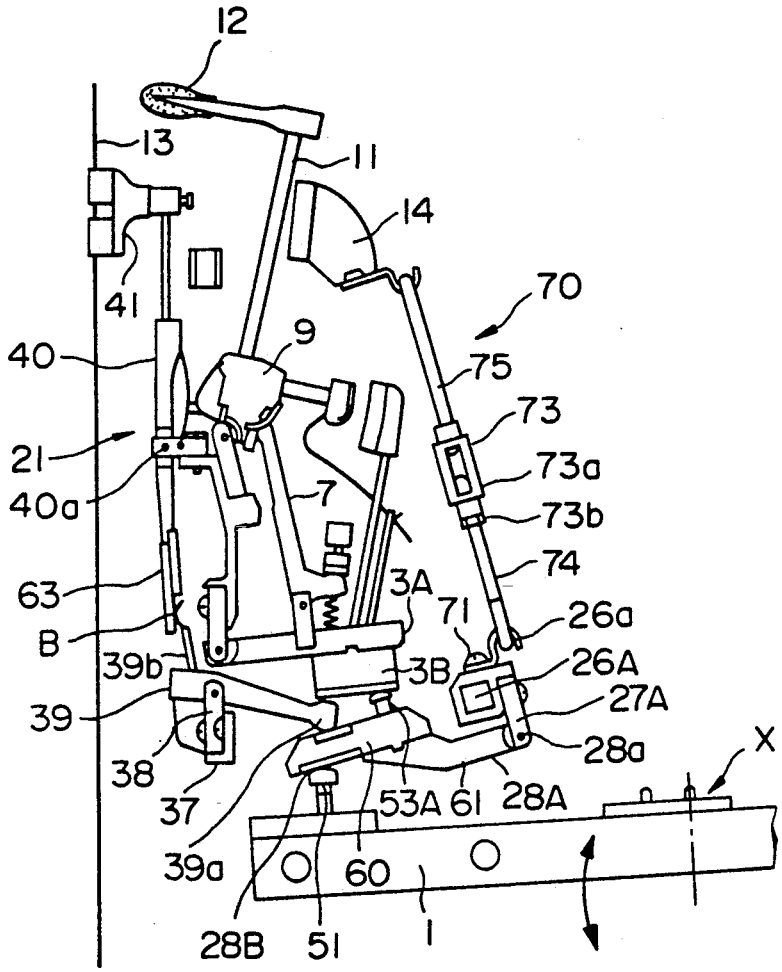
FIG. 10 is a sectional view illustrating an essential part of the muting device in a state of muting performance.

FIGS. 9 and 10 illustrates a muting device according to a third embodiment of the present invention, wherein parts identical to those of the second embodiment will be designated by the same numerals. This third embodiment is different from the second embodiment in the following four points.

(i) According to the first difference, the arm 39 which functions as a member of the damper mechanism 21 is extended in front direction and the tip edge portion thereof is formed to function as the first drive button 52 of the second embodiment. As described before, this arm 39 is supported by the flange 38 fixed to the damper rail 37 such that it can freely swing. The extended tip edge portion of this arm 39 is shaped as a projection portion **39*a* which is inserted between a wippen heel 3B of a wippen 3A and a bypass lever 28A, so that this portion 39*a*** functions as the foregoing first drive button.

Herein, height of the projection portion **39*a* is set slightly higher than that of a second drive button 53A. Due to such height settings, when adjusting the piano action, it is merely required to adjust the height of the capstan button 51**.

(ii) According to the second difference, the swing center **28*a* of the bypass lever 28A is lowered as low as possible such that it is placed at a position lower than the axis line of the bypass lever 28A. The bypass lever 28A is configured by two members, i.e., the capstan button 51 or the projection portion 39*a*, which functions as the foregoing first drive button, and a bypass lever supporting portion 61, wherein this bypass lever supporting portion 61 is linked at and extended from a front side surface of the bypass lever 61. The tip edge portion of this bypass lever supporting portion 61 is supported by a lower surface of a flange 27A fixed to a bypass lever rail 26A such that it can freely swing. The swing center 28*a* of the bypass lever 28A is positioned as low as possible within a range in which the swing motion thereof does not affect the swing motion of the key 1. Incidentally, flexible material 28B such as the cloth is attached at a position at which the capstan button 51 comes in contact with the lower surface of the bypass lever 28A**.

(iii) According to the third difference, a connection point B, at which the damper lever 40 comes in contact with a damper spoon **39*b* extending upward from a base edge portion of the arm 39, is shifted downward such that it is positioned apart from a swing center 40*a* of the damper lever 40. In addition, there is set an arm-length-ratio between the horizontal length and vertical length of the arm 39. Herein, the horizontal length corresponds to a distance between a swing center 39*c* and a point at which the projection portion 39*a* contacts with the bypass lever 28A, while the vertical length corresponds to a distance between the swing center 39*c* and a point B at which the damper spoon 39*b* contacts with the damper lever 40. According to the set ratio, the horizontal length is set longer than the vertical length. In short, a metal fixture 63 to which the cloth and the like is adhered is attached to the lower portion of the damper lever 40, which extends the substantial length between the swing center 40*a* of the damper lever 40 and the connection point B at which the damper spoon 39*b* contacts with the damper lever 40. In addition, length of the damper spoon 39*b* is set shorter than that of the damper spoon of the second embodiment. Further, as described before, the tip edge portion of the arm 39 of the third embodiment is extended longer to function as the first drive button. By setting the desirable arm-length-ratio, it is possible to obtain the proper motion of the damper 41**.

(iv) According to the fourth difference, the bypass lever rail 26A, which is moved upward/downward in response to the step-on operation of the soft pedal, is interconnected to the hammer rail 14 by means of a connection mechanism 70. More specifically, a stopper **26*a* is fixed to the bypass lever rail 26A by a bolt 71, while another stopper 14*a* is fixed to the hammer rail 14. In addition, connection rods 74, 75 are connected together co-axially by means of a length-adjusting means 73 and edge portions thereof are respectively connected to the above-mentioned stoppers 26***a*, 14*a*. The connection rod 75 is connected to a box-shaped nut member 73*a* of the length-adjusting means 73 such that it can freely rotate, while another connection rod 74 is engaged with this nut member 73*a*. In addition, the connection rod 74 is fastened to the nut member 73 by a release/fasten nut 73*b*.

(2) Operation

Next, description will be given with respect to the operation of the third embodiment.

(a) Normal Performance

In the normal performance as illustrated in FIG. 9 wherein the soft pedal is not depressed, only the projection portion 39*a*, which functions as the first drive button, is in contact with the lower surface of the wippen 3A. In this state, an input of the key to be depressed is transmitted in an order of the capstan button 51, bypass lever 28A, projection portion 39*a* and wippen 3A, so that the hammer head 12 will strike the string 13.

(b) Muting Performance

When stepping on the soft pedal, the bypass lever rail 26A is raised and rotated in counterclockwise direction, so that the bypass lever 28A is approximately rotated about the summit portion of the capstan button 51 in counterclockwise direction. Accompanied with this motion, the second drive button 53A is raised up. This operation prevents a gap from being formed between the jack 7 and hammer butt 9. At the same time, the projection portion 39*a*, which comes in contact with the power-transmission-path reaching from the key to the wippen 3A, is changed over to the second drive button 53A, which means that the swing center of the wippen 3A is moved toward the rotation center X of the key 1.

Next, an input of the key to be depressed is transmitted in an order of the capstan button 51, bypass lever 28A, second drive button 53A and wippen 3A. At this time, the projection portion 39*a*, which functions as the first drive button, pushes up the wippen 3A in the vicinity of the jack escape position.

In the third embodiment, the tip edge portion of the arm 39 is extended in front direction to form the projection portion 39*a*, which functions as the first drive button. Since the first drive button and arm are constructed in one body, it is possible to reduce the number of parts.

In addition, the swing center 28*a* of the bypass lever 28A is lowered toward the key 1. Therefore, it is possible to improve the operational line between the bypass lever 28A and key 1, by which it is possible to reduce a slip amount between the capstan button 51 and heel portion 28B of the bypass lever 28A as small as possible. As a result, it is possible to avoid the friction of the heel portion 28B and capstan button 51. In addition, it is also possible to reduce the frictional force occured therebetween.

Further, connection point between the damper lever 40 and damper spoon 39*b* extending upward from the base edge portion of the arm 39 is set apart from the swing center 40*a* of the damper lever 40. Furthermore, the arm-length-ratio between the horizontal length and vertical length of the arm 39 is set such that the horizontal length is longer than the vertical length. Thus, it is possible to obtain the proper distance by which the damper head 41 departs from the string 13.

Lastly, this invention may be practiced or embodied in still other ways without departing from the spirit or essential character thereof. Therefore, the preferred embodiments described herein are illustrative and not restrictive, the scope of the invention being indicated by the appended claims and all variations which come within the meaning of the claims are intended to be embraced therein.

What is claimed is:

1. A muting device for an upright piano comprising:

a butt which rotates with a hammer striking a string of the upright piano;

a wippen which supports a jack such that the jack can be freely rotated, wherein the jack displaces the butt in response to a displacement of a key;

a first capstan button, provided at a back edge portion of the key, for transmitting the displacement of the key to the wippen;

a muting mechanism for rotating the hammer so that a string-striking stroke is reduced; and key-displacement-transmission-rate changing means for, when reducing the string-striking stroke with the muting mechanism, moving a displacement transmission point, at which displacement of the key is transmitted to the wippen, toward a rotation center of the key from the capstan button.

2. A muting device of upright piano as defined in claim 1 wherein the key-displacement-transmission-rate changing means includes a second capstan button placed on an upper surface of the key at a position disposed between the capstan button and the rotation center of the key.

3. A muting device for an upright piano according to claim 2, wherein said key-displacement-transmission-rate changing means includes:

a bypass lever for transmitting the displacement of the key by the second capstan button, and a drive button disposed on an upper surface of the bypass lever for transmitting the displacement of the key to the wippen.

4. A muting device for an upright piano according to claim 1, wherein the key-displacement-transmission-rate changing means further comprises a bypass lever for transmitting the displacement of the key by the first capstan button, the muting device further including first and second drive buttons respectively disposed on an upper surface of the bypass lever, at least one of the first and second drive buttons transmitting the displacement of the key to the wippen.

* * * * *